United States Patent [19]

Ogawa et al.

[11] 4,284,714

[45] Aug. 18, 1981

[54] METHOD OF FORMING A PHOTOGRAPHIC IMAGE

[75] Inventors: Junkichi Ogawa; Mitsugu Tanaka; Minoru Yamada, all of Minami-ashigara, Japan

[73] Assignee: Fuji Photo Film Co., Ltd., Minami-ashigara, Japan

[21] Appl. No.: 148,478

[22] Filed: May 9, 1980

[30] Foreign Application Priority Data

May 9, 1979 [JP] Japan ..... 54-57430

[51] Int. Cl.[3] ..... G03C 7/00

[52] U.S. Cl. ..... 430/364; 430/402; 430/468; 430/473; 430/552; 430/565

[58] Field of Search ..... 430/364, 384, 402, 552, 430/565, 473, 468

[56] References Cited

U.S. PATENT DOCUMENTS

| | | | |
|---|---|---|---|
| 2,220,908 | 11/1940 | Kendall et al. | 430/552 |
| 2,689,793 | 9/1954 | Weller et al. | 430/384 |
| 3,734,735 | 5/1973 | Bovies | 430/21 |
| 3,770,431 | 11/1973 | Gates et al. | 430/214 |
| 3,955,983 | 5/1976 | Nakajima et al. | 430/364 |
| 4,049,454 | 9/1977 | Van Doorselaer et al. | 430/364 |
| 4,126,461 | 11/1978 | Pupo et al. | 430/402 |

*Primary Examiner*—J. Travis Brown

*Attorney, Agent, or Firm*—Sughrue, Mion, Zinn, Macpeak and Seas

[57] ABSTRACT

A method is described for forming a black-and-white photographic image consisting essentially of a silver image and a coextensive dye image, in which the maximum density of the image and the fastness of the image to light are greatly improved, by processing a silver halide photosensitive material which contains silver halide in a reduced amount (compared with conventional materials) that has been imagewise exposed to light in the presence of a naphthalene compound containing at least two hydroxy substituents groups on the nucleus thereof and a p-phenylenediamine type developing agent or a precursor of the p-phenylenediamine compound.

9 Claims, No Drawings

METHOD OF FORMING A PHOTOGRAPHIC IMAGE

BACKGROUND OF THE INVENTION

1. Field of the Invention

The present invention relates to a novel method of forming a photographic image and more particularly, to a method of forming a photographic image consisting of metallic silver and a dye.

2. Description of the Prior Art

In the general method of forming a black-and-white photographic image, a silver halide photosensitive material is imagewise exposed to light to form a latent image therein, and is then development-processed with a developing solution containing a commonly used black-and-white developing agent (such as hydroquinones, aminophenols, 3-pyrazolidones, etc.) to produce metallic silver in the area where the latent image had been formed. Thus the silver is directly utilized as the black-and-white image, while the developing agent that has been oxidized in developing the silver is removed from the photographic system since it has already become useless.

However, if such an oxidized developing agent as described above is utilized to effect the formation of a dye with an imagewise distribution in the photosensitive material, attainable maximum density of the photographic image can be increased and consequently, the amount of silver required in forming the image can be reduced, since the density of the photographic image is the sum of both the density of the silver image and the density of the dye image.

Various methods have been reported for implementing such a system. For instance, U.S. Pat. No. 3,114,833 describes double-layer color X-ray sensitive materials, and U.S. Pat. No. 3,734,735 describes a method of forming a blue colored dye image that is coextensive (that is, formed in the same image areas) with the silver image, utilizing a cyan coupler.

However, cyan couplers such as those described in U.S. Pat. No. 3,734,735 often suffer from the defect that they tend to form unstable dyes.

Another such system is described in U.S. Pat. No. 4,126,461. However, it is difficult to attain satisfactorily high maximum density using the couplers of resorcinol derivatives as described in U.S. Pat. No. 4,126,461.

SUMMARY OF THE INVENTION

Therefore, a primary object of the present invention is to provide a novel method for forming an image capable of using a reduced amount of coated silver through the coextensive formation of a silver image and a dye image.

Another object of the present invention is to provide a color image possessing high fastness to light, heat, moisture, etc., (that is, the image is stable upon exposure to light, heat, moisture, etc.).

Still another object of the present invention is to provide a method in which the amount of silver that is required to be coated for satisfactory image production is reduced compared with the above-described known techniques.

The above-described objects of the present invention are achieved by forming a photographic image consisting of metallic silver and a dye by a method of development processing an imagewise exposed silver halide photosensitive material in the presence of a naphthalene compound containing at least two hydroxy substituted groups on the nucleus thereof and a p-phenylenediamine type developing agent or a precursor of the p-phenylenediamine compound.

DETAILED DESCRIPTION OF THE INVENTION

A photographic image formed according to the method of the invention consists of silver and a particular type of dye. Such a dye image is formed by the reaction of a particular coupler (a hydroxynaphthalene) with the oxidized developing agent of a p-phenylenediamine type developer.

Naphthalene compounds preferably employed according to the invention can be represented by the following formula (I):

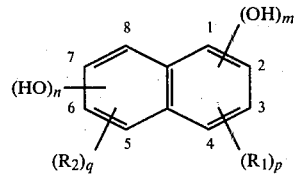

(I)

wherein m and n each represents 0, 1 or 2, and the total of m+n must be at least 2. Most preferably, m+n=2.

In formula (I), p and q each represents 0, 1, 2, 3 or 4, and $R_1$ and $R_2$, which may be the same or different, each represents a hydrogen atom or a group capable of rendering the naphthalene compound diffusion resistant.

Of these naphthalene compounds, dihydroxynaphthalenes which are substituted with hydroxy groups at the 2- and the 3-positions, the 1- and the 3-positions, the 1- and the 6-positions, and the 1- and the 7-positions are particularly preferable according to the invention.

The diffusion resistant groups that can be used are those that are generally known as hydrophobic groups or ballast groups in the art, and preferably are those which contain from 8 to 16 carbon atoms. The ballast group described above need not be a hydrophobic group but virtually is a hydrophobic group frequently.

These ballast groups are attached to the carbon atoms on the naphthalene nucleus, either directly, or indirectly through polyvalent linking groups, preferably, divalent linking group (hereinafter "linkages"), such as an amino linkage, an ether linkage, a thioether linkage, a carboamido linkage, a sulfoamido linkage, a carbamoyl linkage, a sulfamoyl linkage, an ureido linkage, an ester linkage, an imido linkage, a carbonyl linkage, a sulfonyl linkage or the like.

Specific examples of ballast groups that can be used include alkyl groups, alkenyl groups, alkoxyalkyl groups, alkylaryl groups, alkylaryloxyalkyl groups, acylamidoalkyl groups, alkoxyaryl groups, aryloxyaryl groups, carboxyl- or sulfone-substituted alkyl or alkenyl groups, alkyl groups substituted with ester groups, alkyl groups substituted with aryl groups, alkyl groups substituted with aryloxyalkoxycarbonyl groups, and so forth.

In the methods of forming color photographic images using a dye coupling development process which have been most commonly used heretofore, 1-naphthols have been generally employed as a cyan coupler, and dihydroxynaphthalenes, such as 1,5-dihydroxynaphthalene, 3,6-dibromo-1,5-dihydroxynaphthalene and the like are also known as cyan couplers.

However, these compounds employed for the purpose of the formation of cyan dye images in the absence of silver, and the usefulness of these compounds for the attainment of the objects of the present invention has not been known.

The present invention differs from the conventional dye coupling development process in a number following respects; e.g., (i) the method must provide for both a dye image and also a silver image having great covering power, (ii) with respect to the spectral absorption characteristics of the dye image, it is desirable that they consist a broad absorption range (in contrast, in the conventional dye coupling development process, a desirable spectral absorption characteristics is the sharpness of the absorption spectrum and the restriction on the wavelength absorption range, and (iii) the formation of an image having grayish (neutral gray) tone, rather than a colored image, is desirable.

Since the criteria for the choice of a desirable coupler according to this invention differ so drastically from the criteria for forming a cyan dye in a color photographic system, as described above, it could not be predicted that any coupler would be satisfactory. However, it has been found that compounds suitable for use in this invention include dihydroxynaphthalenes as illustrated hereinbefore, and the above-described two compounds already known as a cyan coupler, though they are included in the class consisting of compounds represented by the general formula of the present invention, can not be employed in preferred embodiments of the present invention.

Typical examples of p-phenylenediamine type developing agents which can be preferably employed in the present invention include N,N-diethyl-p-phenylenediamine hydrochloride; 4-amino-3-methyl-N,N-diethylaniline hydrochloride; 4-[N-ethyl-N-(β-hydroxyethyl-)amino]aniline sulfate; 4-amino-3-methyl-N-ethyl-N-(β-hydroxyethyl)aniline sulfate; 4-amino-3-methyl-N-ethyl-N-(β-methanesulfonamidoethyl)aniline sesquisulfate monohydrate, as described in U.S. Pat. No. 2,193,015; 4-amino-3-(β-methanesulfoamidoethyl)-N,N-diethylaniline sulfate, as described in U.S. Pat. No. 2,592,364; N,N-diethyl-p-phenylenediamine hydrochloride; 4-amino-3-methyl-N-ethyl-N-methoxyethylaniline, 4-amino-3-methyl-N-ethyl-N-β-ethoxyethylaniline and 4-amino-3-methoxy-N-ethyl-N-β-butoxyethylaniline or the salts thereof (e.g., sulfates thereof, sulfites thereof, p-toluenesulfonates thereof, etc.), as described, for example, in U.S. Pat. Nos. 3,656,950 and 3,698,525. In addition, compounds which are described in L. F. A. Mason, *Photographic Processing Chemistry,* pages 226–229, Focal Press, London (1966) are also included as preferable p-phenylenediamine type developing agents according to the invention.

Typical examples of a precursor of the p-phenylenediamine compound are described in British Pat. Nos. 998,949, 1,069,061 and 1,374,807, U.S. Pat. Nos. 3,342,599, 3,705,035 and 3,719,492, *Research Disclosure,* 12,924, and German Patent Application (OLS) Nos. 1,159,758 and 1,200,679. Said precursor is included in a light-sensitive photographic material but not a developing solution.

Specific examples of naphthalene compounds which can be employed in the method of the invention are illustrated below. However, the invention is not intended to be construed as being limited by these examples.

I-1 2,3-Dihydroxynaphthalene,
I-2 1,6-Dihydroxynaphthalene,
I-3 2,3-Dihydroxynaphthalene dibenzoate,
I-4 1,7-Dihydroxynaphthalene,
I-5 1,3-Dihydroxynaphthalene,
I-6 5-n-Pentadecylenecarbonamido-1,3-dihydroxynaphthalene,
I-7 5-n-Pentadecyl-1,3-dihydroxynaphthalene.

These compounds can be prepared according to methods as described in Munio Kotake, supervision, *Dai-Yuki Kagaku* (*Grand Organic Chemistry*), Volume 11, pages 210–217, and in U.S. Pat. No. 3,770,431.

Although images formed in accordance with this invention exhibit a substantially black coloration the invention also includes images having shades of other colors, for example, brown, blue, and green. These images are formed so as to be superimposed on the silver image (i.e., coextensive), and the total density of images is thereby increased. Therefore, the formation of such a dye image enables a reduction in the amount of silver required for obtaining a desired image density.

The naphthalene compounds used according to the invention can be incorporated into either the developing solution or the photo-sensitive materials. When added to the developing solution, the naphthalene compound can be used in an amount ranging from about 0.1 g/l to 30 g/l, and preferably from 0.2 g/l to 20 g/l. On the other hand, when incorporated in a sensitive material, the naphthalene compound can be used in an amount ranging from about 0.1 $g/m^2$ to 10 $g/m^2$, and preferably from 0.2 $g/m^2$ to 5 $g/m^2$.

The process according to the method of the invention includes essentially a developing step and a fixing step, and optionally, a washing step and a stopping step. After completion of the process, a drying process can also be carried out.

The process can generally be carried out at a temperature of from about 10° C. to 70° C., and although temperature is not critical a preferable process temperature range is from 20° C. to 60° C.

The process can be carried out at pH range of 7 to 14, and preferable process pH range is from 8 to 11.

In addition to the above-described compounds, the developing solution can contain other known constituent compounds therefor. For instance, sodium hydroxide, potassium hydroxide, sodium carbonate, potassium carbonate, sodium or potassium tertiary phosphate, potassium metaborate, borax and the like can be employed as an alkali agent and a buffer independently or in combination. Further, various kinds of salts, for example, disodium hydrogenphosphate, dipotassium hydrogenphosphate, sodium dihydrogenphosphate, potassium dihydrogenphosphate, sodium hydrogencarbonate, potassium hydrogencarbonate, boric acids, alkali nitrates, alkali sulfates, etc., are employed for the purpose of imparting a buffer capacity to the developing solution, convenience for preparation of the developing solution or increasing the ionic strength thereof.

Antifoggants can also be added to the developing solution if desired. Examples of antifoggant in the halides of alkalimetals such as potassium bromide, sodium bromide, potassium iodide and the like, and organic antifoggants can also be employed. Specific examples of the organic antifoggants include: nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole and the like; heterocyclic compounds substituted with mercapto groups, such as 1-phenyl-5-mercaptotetrazole, 2-mercaptobenzimidazole, 2-mercaptobenzothiazole and the like; and aromatic compounds substituted with mercapto groups, such as thiosalicylic acid and the like. Of these antifogging compounds, nitrogen-containing heterocyclic compounds are preferred, and particularly preferable ones are the nitrogen-containing heterocyclic compounds not having mercapto groups as substituents. Such antifoggants can be used in an amount ranging from 1 mg to 5 g, and preferably in an amount from 5 mg to 1 g, per one liter of the developing solution.

Specific examples of the nitrogen-containing heterocyclic compounds not having mercapto groups as substituents that can be used include known. For example, the use of nitrobenzoimidazoles is described in U.S. Pat. No. 2,496,940; British Pat. No. 403,789; U.S. Pat. Nos. 2,497,917 and 2,656,271; and so on. Benzotriazoles that can be used are described in *Nippon Shashin Gakkai Shi* (*Journal of Japanese Photographic Society*), Volume 11, page 48 (1948). Quaternary salts of heterocyclic rings such as benzthiazolium salts that can be used are described, for example, in U.S. Pat. Nos. 2,131,038, 2,694,716, and 3,326,681. Tetrazaindenes that can be used are described, for example, in U.S. Pat. Nos. 2,444,605, 2,444,606, and 2,444,607. Examples of other heterocyclic compounds that can be used are described in U.S. Pat. Nos. 2,173,628, 2,324,123, and 2,444,608, and in *Kagaku Shashin Binran* (*Handbook for Scientific Photography*), Volume 2, page 119, Maruzen, Tokyo (1959).

Other components that may be included in the developing solution as preservatives include a sulfate or hydrochloride of a hydroxylamine, sodium sulfite, potassium sulfite, and potassium or sodium hydrogensulfite.

Any known development accelerator can be added to the developing solution if necessary. Examples of development accelerators include various kinds of pyridinium compounds and other cationic compounds, including: cationic dyes, such as phenosafranine, and neutral salts, such as thallium nitrate and potassium nitrate, as described in U.S. Pat. No. 2,648,604, Japanese Patent Publication 9503/69, and U.S. Pat. No. 3,671,247; polyethylene glycol and derivatives thereof, and nonionic compounds, such as polythioethers, as described in Japanese Patent Publication 9504/69, U.S. Pat. No. 2,533,990, U.S. Pat. No. 2,531,832, U.S. Pat. No. 2,950,970 and U.S. Pat. No. 2,577,127; organic solvents and organic amines, such as ethanolamine, ethylenediamine, and diethanolamine, as described in Japanese Patent Publication 9509/69 and Belgian Patent 682,862; and so forth. Accelerators described in L. F. A. Mason, *Photographic Processing Chemistry,* pages 40–43, Focal Press, London (1966) may also be added to the developing solution prepared in accordance with the invention.

Besides the above-described development accelerators, benzyl alcohol and phenylethyl alcohol, as described in U.S. Pat. No. 2,515,147, and pyridine, ammonia, hydrazine and amines, as described in *Journal of Japanese Photographic Society,* Volume 14, page 74 (1952), can also be used as development accelerators.

Furthermore, as a preferred embodiment 3-pyrazolidone type auxiliary developers can be added to the developing solution used according to the present invention. Specific examples thereof include 1-phenyl-4,4-dimethyl-3-pyrazolidone, 1-phenyl-4-methyl-4-hydroxymethyl-3-pyrazolidone, and 1-phenyl-4,4-dihydroxymethyl-3-pyrazolidone, and compounds as described in P. Glafkides, *Chimie et Physique Photographiques,* Paul Montel, Paris (1976) page 148.

Introduction of the hydroxynaphthalene compounds according to the invention into hydrophilic colloids constituting silver halide photosensitive materials can be performed using various known techniques.

When the hydroxynaphthalene compound to be employed in the practice of the invention is soluble in water, it can be added to a hydrophilic colloid in the form of aqueous solution having a concentration of about 10 to 20% by weight.

On the other hand, when the hydroxynaphthalene compound to be employed in the present invention is soluble in an organic solvent, it can be added to a hydrophilic colloid to constitute a photographic layer in a form of solution obtained by dissolving it in an organic solvent of a type that does not exert any adverse influence upon photographic characteristics and that, has a low boiling point or miscibility with water. Examples include a solvent such as alcohols (e.g., methanol, ethanol, isopropanol, butanol, etc.), ethers (e.g., dimethyl ether, ethyl methyl ether, diethyl ether, 1-ethoxypropane, etc.), glycols (e.g., 1,2-ethanediol, 1,2-propanediol, 1,3-propanediol, etc.), ketones (e.g., acetone, ethyl methyl ketone, 3-pentanone, etc.), esters (e.g., ethyl formate, methyl acetate, ethyl acetate, etc.) and amides (e.g., formamide, acetoamide, succinamide, etc.).

Other examples of methods for introducing a hydroxynaphthalene according to the invention into a hydrophilic colloid constituting a photographic layer include methods for adding color couplers to hydrophilic colloidal layers in an emulsified form. More particularly, methods are described in U.S. Pat. No. 2,322,027 and U.S. Pat. No. 2,304,939; the hydroxynaphthalene compound is dissolved in an organic solvent and then emulsified using a surface active agent to form dispersion in water; the resulting dispersion is then added to a hydrophilic colloid for use in making a photographic layer. The organic solvent employed therein may be a high boiling point organic solvent (e.g., having a boiling point higher than about 175° C.) or a low boiling point organic solvent (e.g., having a boiling point ranging from about 30° C. to 150° C.). Furthermore, it may be a mixed solvent, obtained by mixing a high boiling point organic solvent and a low boiling point organic solvent in an arbitrary ratio. Low boiling point organic solvents that can be used in such emulsification methods include those which are set forth in the method described above using an organic solvent solution of the hydroxynaphthalene. Examples of high boiling point organic solvents that can be used in such emulsification methods include di-n-butyl phthalate, benzyl phthalate, triphenyl phosphate, tri-o-cresyl phosphate, diphenyl mono-p-tert-butylphenyl phosphate, monophenyl di-p-tert-butylphenyl phosphate, diphenyl mono-o-chlorophenyl phosphate, monophenyl di-o-chlorophenyl phosphate, 2,4-di-n-amylphenol, 2,4-di-tert-amylphenol, N,N-diethyllauramide, trioctylphosphate and trihexylphosphate as described, for example, in U.S. Pat. No. 3,676,137.

Hydroxynaphthalene compounds and the 3-pyrazolidone type developers that are soluble in water or a low boiling point organic solvent can be dissolved in such a solvent in a concentration of about 10 to 20% by weight, and the resulting solution can be added to the developing solution for use according to the method of the invention. If the 3-pyrazolidone type auxiliary developer is soluble in water or in a low boiling point organic solvent, it can also be added to a hydrophilic colloid to be used in forming a photographic layer in the form of solution dissolved in such a solvent.

When the hydroxynaphthalene compounds according to the invention and/or the preferred 3-pyrazolidone type auxiliary developer is soluble in water, the water-soluble compound and/or developer may be added to the developing solution as a solid without being previously dissolved in any solvent.

Introduction of the hydroxynaphthalene compound and or 3-pyrazolidone type auxiliary developer according to the method of the invention into a hydrophilic colloid forming a photosensitive material may be carried out in any of the process step used for preparing the photosensitive material, but it is desirable that such incorporation be made prior to the coating process step, and preferably is made in the process step of preparing the coating solution for forming photographic layer.

Generally speaking, in-camera photographic materials contain silver salts in amounts ranging from (in terms of the amount of silver, hereinafter expressed as g $Ag/m^2$) 3 to 10 $g/m^2$, and even photographic printing materials contain silver in amounts ranging from about 1 to about 4 g $Am/m^2$. In photosensitive materials to be treated by the method of this invention, on the other hand, the silver amounts coated can be less than 7 $g/m^2$, preferably about 0.1 to 7 $g/m^2$, and, in so far as the photosensitive material is employed for the same purpose, the photosensitive material to be treated according to the method of this invention can contain 20% less silver than the conventional photosensitive material.

The silver halide emulsion is, in general, prepared by mixing a water soluble silver salt (e.g., silver nitrate) with a water soluble halide (e.g., potassium bromide) in the presence of a solution of a water-soluble polymer such as gelatin. Examples of such silver halides include not only silver chloride and silver bromide but also mixed silver halides, such as silver chlorobromide, silver iodobromide, silver chloroiodobromide, and silver chloroiodide.

Grains of these silver halides may have a crystals of a cubic type, an octahedral type, or a mixed type thereof.

Also, two or more kinds of silver halide photographic emulsions which are prepared separately may be mixed to form an emulsion for use in the invention. Moreover, the crystal structure of silver halide grains may be uniform throughout, or may comprise a layer structure in which the inner part and the outer part differ in their structure, or may comprise the so-called conversion type structure, as is described in British Pat. No. 635,841 and U.S. Pat. No. 3,622,318. In addition, the silver halide photosensitive emulsions may be emulsions of the type which form latent image at the surfaces of the grains to a very appreciable extent, or emulsions of the kind which form latent image inside the grains and substantially no latent image on the surfaces of the grains. These photosensitive emulsions are described in C.E.K. Mees & T. H. James, *The Theory of the Photographic Process,* 3rd Ed., pages 1 to 71, MacMillan Ltd., New York (1966); P. Glafkides, *Chime Photographique,* pages 57 to 82, Paul Montel, Paris (1957) and so on, and can be prepared according to the generally known ammonia process, neutral process, acid process or the like.

The above-described silver halide emulsions can be also subjected to chemical sensitization. Chemical sensitizers used therefor can include, for example: gold compounds such as chloroaurates, gold trichloride and the like, as described in U.S. Pat. Nos. 2,399,083, 2,540,085, 2,597,856 and 2,597,915; salts of noble metals such as platinum, palladium, iridium, rhodium and ruthenium, as described in U.S. Pat. Nos. 2,448,060, 2,540,086, 2,566,245, 2,566,263 and 2,598,079; sulfur compounds capable of producing silver sulfide by reacting with silver salts, such as those described in U.S. Pat. No. 1,574,944, 2,410,689, 3,189,458 and 3,501,313; and reducing agents such as stannous salts, amines, and so forth, as described in U.S. Pat. Nos. 2,487,850, 2,518,698, 2,521,925, 2,521,926, 2,694,637, 2,983,610 and 3,201,254.

In order to impart desired developing characteristics, image characteristics, and film properties to photosensitive materials, it is preferred in some cases to add various additional additives to the photosensitive materials. Examples of such additives include: iodides having a salt form; mercapto-free radicals organic compounds, such as phenylmercaptotetrazole and the like; iodides of alkali metals; and so forth, but it is generally desirable to avoid using such additives in large amounts.

Antifogging agents which are generally added to the light sensitive silver halide emulsions layers and light insensitive auxiliary layers of photosensitive materials may also be used in combination with the compounds used according to the invention.

Other additives such as hardening agents, plasticizers, lubricants, surface agents, brighteners and other additives known in the art of photographic techniques may be incorporated in photographic elements.

Specific examples of hydrophilic colloids that can be used in the practice of the invention include gelatin, colloidal albumin, casein, cellulose derivatives such as carboxymethyl cellulose, hydroxyethyl cellulose, agar, sodium alginate, sugar derivatives such as starch derivatives and the like, and synthetic hydrophilic colloids such as polyvinyl alcohol, poly-N-vinyl pyrrolidone, polyacrylic acid copolymers, polyacryl amide and derivatives thereof or partially hydrolized products thereof or partially hydrolized products thereof. If desired, these colloids may be used in a form of compatible mixture of two or more kinds. Of these colloids, the most commonly used colloid is gelatin. However, gelatin can be replaced by a synthetic macromolecular substances in part or in whole, and gelatin derivatives may be also employed.

The photographic emulsions can optionally be subjected to spectral sensitization and supersensitization, using cyanine dyes such as cyanines, merocyanines, carbocyanines and the like, independently or in combination, or using the combination of one of the above-described cyanine dyes and a styryl dye or the like. These color sensitization techniques are well known, and are described, for example, in: U.S. Pat. Nos. 2,493,748, 2,519,001, 2,977,229, 3,480,434, 3,672,897, 3,703,377, 2,688,545, 2,912,329, 3,397,060, 3,615,635 and 3,628,964; British Pat. Nos. 1,195,302, 1,242,588 and 1,293,862; German Pat. Applications (OLS) Nos. 2,030,326 and 2,121,780; Japanese Pat. Publications Nos. 4936/68, 14030/69 and 10773/68; U.S. Pat. Nos. 3,511,664, 3,522,052, 3,527,641, 3,615,613, 3,615,632, 3,617,295, 3,635,721 and 3,694,217; British Pat. Nos. 1,137,580 and 1,216,203 and so forth. The particular technique is selected is determined depending upon the wavelength region in which sensitization is desired, the sensitivity to be attained, the purpose of end-use of the sensitive material, and so forth.

As the photographic support, materials which are commonly used in photographic light sensitive materials, such as a cellulose nitrate film, a cellulose acetate film, a cellulose acetate butyrate film, a cellulose acetate propionate film, a polystyrene film, a polyethylene terephthalate film, a polycarbonate film, laminates or said films, a thin glass plate, a sheet of paper and the like can be employed. Preferred supports include: baryta paper; paper coated or laminated with α-olefin polymer, particularly the polymer of α-olefin having 2 to 10 carbon atoms, such as polyethylene, polypropylene, ethylene-butene copolymer or the like; and plastic films having improved adhesion to other high polymers by rendering the surfaces thereof rough, as described in Japanese Patent Publication No. 19068/72.

Whether the support is used in a transparent state or is rendered opaque depends upon the end-use of the photosensitive material. When a transparent support is desired, the transparent support may be colored, if desired, by addition of a dye or a pigment, or it may be colorless. Such coloration techniques regarding the support have been used in the art of X-ray films and the like, and are described in J. SMPTE (an abbreviated name of Publication of the Society of Motion Picture and Television Engineers), Volume 67, page 296 (1958).

Opaque supports include not only those that are naturally opaque, such as paper, but also: plastic films which are naturally transparent but are rendered opaque by the addition of dyes or pigment, such as titanium oxide and the like; plastic films subjected to a surface treatment according to a method as described in Japanese Patent Publication No. 19068/72; paper and plastic films which are shielded completely from the transmission of light by the addition of carbon black, dyes or the like; and so. In addition, a subbing layer having adhesion to both the support and the photographic emulsion layer on the support can be provided. Furthermore, in order to obtain improved adhesion of the support to a photographic emulsion layer, the surface of the support may receive a pre-treatment, such as a corona discharge treatment, an ultraviolet ray irradiation treatment, a flame treatment or the like.

Layers of the photographic element which are to be provided on support in accordance with the practice of the invention may be formed using, for example, a dip coating method, an air knife coating method, a curtain coating method, or an extrusion coating method using a hopper of the type described in U.S. Pat. No. 2,681,294.

Furthermore, the features of other image intensifying methods such as those as cited below can be also utilized in combination with the method of the present invention.

For instance, various photographic techniques making use of the decomposition of peroxides at the surface of noble metals can be used, as described, for example, in German patent applications (OLS) Nos. 1,813,920, 1,950,102, 1,955,901, 1,961,029, 2,044,833, 2,044,993, 2,056,360, 2,056,359 and 2,120,091.

Color intensification process due to the action of cobalt complex salts on the surface of noble metals can also be used, as described, for example, in published Japanese patent applications (OPI) Nos. 9728/73, 9729/73, 48130/73, 84229/74, 84239/74, 84240/74, 97614/74, 102340/74 and 102341/74 (The term "OPI" as used herein refers to a "published unexamined Japanese patent application.)."

In addition, another color intensification process that can be used employs the use of halous acids, such as chlorite and the like, as is described in published Japanese Patent Application (OPI) 53826/76 and Japanese Patent Application 139917/74.

The present invention will now be illustrated in greater detail by reference to the following examples.

EXAMPLE 1

A photosensitive material having, on one side of a polyethylene terephthalate film, in sequence, a gelatin silver iodobromide emulsion layer (having a silver iodide content of 1.5 mole %, a coverage of 40 mg Ag/100 $cm^2$, and a coverage of 50 mg gelatin/100 $cm^2$) and a protecting layer of gelatin (20 mg gelatin/100 $cm^2$) was imagewise exposed to light and then subjected to the following process steps by means of a processor of the roller conveyer type.

| Processing | Temperature | Time |
|---|---|---|
| Development | 35° C. | 3 minutes |
| Fixation | 34° C. | 1 minute |
| Washing | 33° C. | 1 minute |
| Drying | 35° C. | 1 minute |

The developing solution and the fixing solution used had the following proportions of ingredients:

| Composition of Developing Solution | |
|---|---|
| Water | 500 ml |
| Hydroxyethylethylenediamine Triacetic Acid | 0.8 g |
| Sodium Sulfite (Anhydrous) | 5 g |
| Potassium Carbonate | 20.0 g |
| Coupler | described in Table 1 |
| Developer | described in Table 1 |
| Boric Acid | 10.0 g |
| Triethylene Glycol | 25.0 g |
| Glacial Acetic Acid | 3.0 g |
| 5-Nitro-indazole | 0.03 g |
| 1-Phenyl-5-mercaptotetrazole | 0.005 g |
| 5-Methylbenzotriazole | 0.005 g |
| Potassium Bromide | 6.0 g |
| Water | to make 1.0 liter |
| **Composition of Fixing Solution** | |
| Water | 500 ml |
| Ammonium Thiosulfate | 200.0 g |
| Sodium Sulfite (Anhydrous) | 20.0 g |
| Boric Acid | 8.0 g |
| Disodium Ethylenediaminetetraacetate | 0.1 g |
| Aluminium Sulfate | 15.0 g |
| Sulfuric Acid | 2.0 g |
| Glacial Acetic Acid | 22.0 g |
| Water | to make 1.0 liter |

The processor used was an automatic developing machine for X-ray films, Fuji RN (trademark, Fuji Photo Film Co., Ltd.), and the total processing time was 6 minutes.

Results obtained using developing solutions containing different couplers and developers are shown in Table 1.

By the use of developing solutions, Sample Nos. 1 to 4, which contained couplers in accordance with the method of the invention, higher maximum density was obtained, compared with Comparison Sample No. 6 (which did not contain any coupler and for which hydroquinone was used as the developer), and Comparison Sample No. 5 (in which a compound as described in U.S. Pat. No. 4,126,461 was used as a coupler). Therefore, in accordance with the method of the invention, the amount of silver required to be coated to obtain a particular density is less than that required by conventional methods.

TABLE 1

| Sample No. | Coupler | Amount Added g/l | | Amount Added g/l | Maximum Density |
|---|---|---|---|---|---|
| 1 | 2,3-Dihydroxynaphthalene | 1 | 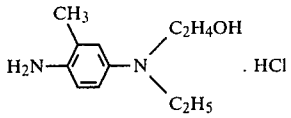 | 3 | 1.62 |
| 2 | 1,3-Dihydroxynaphthalene | 1 | " | 3 | 1.91 |
| 3 | 1,6-Dihydroxynaphthalene | 1 | " | 3 | 1.58 |
| 4 | 1,7-Dihydroxynaphthalene | 1 | " | 3 | 1.51 |
| 5 | n-Decyl-2,6-dihydroxybenzoate | 1 | " | 3 | 1.28 |
| 6 | None | — | " | 3 | 0.82 |
| 7 | None | — | 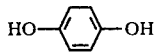 | 3 | 1.33 |

EXAMPLE 2

Two of photosensitive materials (Samples 8 and 9 described in Table 2 below) were prepared by providing on one side of separate polyethylene terephthalate films two different of silver iodobromide (iodide content = 1.5 mole %) emulsion layers and coating gelatin thereon to form protecting layers.

The amounts of components of the photosensitive materials are set forth below in Table 2.

TABLE 2

| | Component | Sample 8 Amount Coated mg/100 $cm^2$ | Sample 9 Amount Coated mg/100 $cm^2$ |
|---|---|---|---|
| Emulsion Layer | Gelatin | 50 | 50 |
| | Silver Iodobromide (mg Ag/100 $cm^2$) | 40 | 40 |
| | 1,3-Dihydroxynaphthalene | — | 20 |
| Protecting Layer | Gelatin | 20 | 20 |

The above-described Samples 8 and 9 were each imagewise exposed to light and development-processed using the same developing solution as employed in Sample from No. 1 to No. 6 of the Example 1 under the same conditions as in Example 1, and then fixed, washed with water, and dried, in a conventional manner.

The results obtained are set forth in Table 3.

TABLE 3

| Experiment No. | Sensitive Material | Maximum Density |
|---|---|---|
| 2-1 | Sample 8 | 0.82 |
| 2-2 | Sample 9 | 1.38 |

As can be seen from Table 3, a higher maximum density was obtained in Sample 9 in which a coupler according to the method of the invention was contained, than in Sample 8, in which no coupler was present.

While the invention has been described in detail and with reference to specific embodiments thereof, it will be apparent to one skilled in the art that various changes and modifications can be made therein without departing from the spirit and scope thereof.

What is claimed is:

1. A method of forming a photographic image consisting of metallic silver and a dye, comprising imagewise exposing a silver halide photosensitive material to light, development processing said material to form an image in the presence of a naphthalene compound selected from the group consisting of 1,3-, 1,6-2,3-, or 1,7-dihydroxynaphthalene and a p-phenylenediamine type developing agent or a precursor of the p-phenylenediamine compound, and fixing said image.

2. A method of forming a photographic image as in claim 1, wherein said dihydroxy naphthalene is substituted with at least one ballast group containing from 8 to 16 carbon atoms.

3. A method of forming a photograhic image as in claim 1, wherein said development processing is conducted in the presence of a 3-pyrazolidone compound.

4. A method of forming a photographic image as in claim 3, wherein said 3-pyrazolidone compound is 1-phenyl-4,4-dimethyl-3-pyrazolidone, 1-phenyl-4-methyl-4-hydroxy-methyl-3-pyrazolidone, or 1-phenyl-4,4-dihydroxymethyl-3-pyrazolidone.

5. A method of forming a photographic image as in claim 1, 2, 3 or 4, wherein said photosensitive material contains from about 0.1 to 7 g Ag/$m^2$.

6. A method of forming a photographic image as in claim 1, 2, 3, or 4, wherein said naphthalene compound is contained in said photosensitive material in an amount of from about 0.1 to 10 g/$m^2$.

7. A method of forming a photographic image as in claim 6, wherein said naphthalene compound is contained in said photosensitive material in an amount from 0.2 g/$m^2$ to 5 g/$m^2$.

8. A method of forming a photographic image as in claim 1, 2, 3, or 4, wherein said naphthalene compound is contained in the developing solution in an amount of from about 0.1 to 30 g/l.

9. A method of forming a photographic image as in claim 8, wherein said naphthalene compound is contained in the developing solution in an amount from 0.2 g/l to 20 g/l.

* * * * *